US006401924B1

(12) United States Patent
Fresnel

(10) Patent No.: US 6,401,924 B1
(45) Date of Patent: Jun. 11, 2002

(54) DEVICE FOR SUPPORTING AT LEAST ONE OBJECT, AND AN ASSOCIATED METHOD OF WRAPPING AT LEAST ONE OBJECT THAT IS TO BE SUPPORTED BY A PEG OF A DISPLAY UNIT

(75) Inventor: Eric Fresnel, Paris (FR)

(73) Assignee: Sleever International Company, Morangis (FR)

( * ) Notice: Subject to any disclaimer, the term of this patent is extended or adjusted under 35 U.S.C. 154(b) by 0 days.

(21) Appl. No.: 09/554,598

(22) PCT Filed: Dec. 8, 1998

(86) PCT No.: PCT/FR98/02655

§ 371 (c)(1),
(2), (4) Date: May 26, 2000

(87) PCT Pub. No.: WO99/30982

PCT Pub. Date: Jun. 24, 1999

(30) Foreign Application Priority Data

Dec. 12, 1997 (FR) ..... 97 15786

(51) Int. Cl.[7] ..... B65D 73/00

(52) U.S. Cl. ..... 206/466; 206/471; 206/806; 206/497

(58) Field of Search ..... 206/466, 497, 206/806, 471; 53/427, 433, 442, 507, 508, 509

(56) References Cited

U.S. PATENT DOCUMENTS

| | | | | | |
|---|---|---|---|---|---|
| 3,863,837 | A | * | 2/1975 | Spiegel et al. | 206/497 |
| 4,166,532 | A | * | 9/1979 | Tsuchida et al. | 206/497 |
| 4,307,804 | A | | 12/1981 | Benham | |
| 4,377,234 | A | * | 3/1983 | Kaplan | 206/432 |
| 4,958,735 | A | * | 9/1990 | Odabashian | 206/497 |
| D320,159 | S | * | 9/1991 | Wallach | 206/497 |
| 5,452,802 | A | * | 9/1995 | Green | 206/466 |
| 5,692,671 | A | * | 12/1997 | Mussier et al. | 229/117.14 |
| 5,701,999 | A | * | 12/1997 | Phillips, II et al. | 206/320 |
| 5,842,632 | A | * | 12/1998 | Van Hest | 229/153 |
| 5,871,090 | A | * | 2/1999 | Doucette | 206/170 |
| 6,125,563 | A | * | 10/2000 | Girerd | 40/310 |

FOREIGN PATENT DOCUMENTS

| | | |
|---|---|---|
| EP | 2 652 064 | 3/1991 |
| EP | 0 698 561 | 2/1996 |
| FR | 2 652 064 | 3/1991 |

* cited by examiner

*Primary Examiner*—Shian Luong
(74) *Attorney, Agent, or Firm*—Nixon Peabody LLP; Stuart J. Friedman

(57) ABSTRACT

The invention relates to a device for supporting at least one object that is to be suspended from a peg of a display unit. According to the invention, it consists in a sleeve (10) of heat-shrink plastics material having a non-shrunk top portion (10.1) which is flattened face against face and has a through hole (11) for suspending the device, and a bottom portion (10.2) which is shrunk on a top portion of the object(s) concerned so as to enable said object(s) to be suspended.

10 Claims, 3 Drawing Sheets

DEVICE FOR SUPPORTING AT LEAST ONE OBJECT, AND AN ASSOCIATED METHOD OF WRAPPING AT LEAST ONE OBJECT THAT IS TO BE SUPPORTED BY A PEG OF A DISPLAY UNIT

FIELD OF THE INVENTION

The present invention relates to a device for supporting at least one object that is to be supported by a peg of a display unit.

BACKGROUND OF THE INVENTION

Numerous shops and stores make use of display unit panels or slides which are fitted with suspension pegs (single pegs or dual pegs) onto which a plurality of supports for objects of a given category are engaged one after another.

Thus, it has long been the practice to use thermoformed shells associated with a card backing plate (blister packs) or indeed pieces of card supporting one or more objects secured thereto by means of a sheet of heat-shrink film whose edges overlie the edges of the card, or indeed various types of bags of plastics material fitted at the top either with a piece of card for suspension purposes, or else with a compartment that receives a piece of reinforcing card that has a hole from which the bag can be suspended.

More recently, use has been made of sleeves of heat-shrink plastics material that serve to hold one or more objects. Thus, support devices are in use that are constituted by two elements that are united to each other, specifically a suspension plate having a hole enabling the plate to be engaged on a display unit peg, which plate also serves as a medium for displaying information, and a heat-shrink sleeve, which, once shrunk, serves to unite one or more objects mechanically with the suspension plate. Under such circumstances, the bottom portion of the plate has a zigzag outline so as to favor engagement with the sleeve during shrinkage thereof, so as to enable said sleeve to withstand the forces encountered when one or more objects are suspended via the plate of the support device.

The drawback of the above-described solution lies in the need to use two components, and the need to organize bonding between those two components at the same time as bonding with one or more objects to be supported. In addition, there still remains the risk of the heat-shrink sleeve being poorly positioned relative to the plate, and such poor positioning can give rise to defective support of the object(s) which can then naturally fall out on the slightest handling by an interested client seeking to take an object off the peg of a display unit.

SUMMARY OF THE INVENTION

A particular object of the invention is to resolve that problem by designing a support device that provides higher performance and that does not have the above-specified drawbacks.

According to the invention, this problem is resolved by a device for supporting at least one object that is to be suspended from a peg of a display unit, the device consisting in a sleeve of heat-shrink plastics material having a non-shrunk top portion which is flattened face against face and has a through hole for suspending the device, and a bottom portion which is shrunk on a top portion of the object(s) concerned so as to enable said object(s) to be suspended.

Thus, unlike the known solution using plates and heat-shrink sleeves, the support device of the invention comprises a single piece, and therefore needs no operation of bonding components together.

In a first embodiment, the through holes passes through both walls of the top portion of the sleeve.

In a variant, in particular when the object(s) concerned is/are very heavy, it is advantageous to make provision for the top portion of the sleeve to have a fold defining an end flap that likewise has a through hole which, once said end flap has been folded down, comes into register with the above-mentioned through hole so as to double the number of walls in the suspension zone.

Preferably, the above-specified fold is defined by a circumferential line of microperforations or by scoring. It is also possible to make provision for the end flap to be fitted with an adhesive member ensuring that said flap is superposed. The adhesive member can be constituted, for example, by an adhesive extension of the end flap, or by an adhesive patch disposed on the inside face of said end flap.

According to another advantageous characteristic of the invention, both walls of the sleeve adhere to each other via an intermediate transverse line marking the boundary between the top portion and the bottom portion of said sleeve. The intermediate transverse line is a line of heat sealing between the two walls of the sleeve, or in a variant a line of adhesive on the two walls of the sleeve provided by means of a temperature-reactivatable adhesive.

Also advantageously, the flap top portion of the sleeve presents printed information and/or decoration.

If necessary, provision can be made for the flat top portion of the sleeve to present a shaped top end. This provides great freedom in shaping the top suspension portion, which can thus be personalized at will as a function of the application concerned.

Also advantageously, the sleeve can carry a detection antenna in the form of a metal wire extending along a generator line of said sleeve, preferably along the full height thereof. This provides a secure package providing discrete and effective protection against "shrinkage".

The invention also provides a method of wrapping at least one object that is to be suspended from a peg of a display unit by means of a heat-shrink sleeve having at least one of the above-specified characteristics, said method being remarkable in that it comprises the following successive steps:

a) the heat-shrink sleeve is engaged on an end portion of the object(s), over a portion only of the length of said sleeve; and b) only that portion of the sleeve which covers the object(s) is caused to shrink, the remaining portion being left unshrunk and being flattened face against face.

Preferably, step a) consists in engaging the heat-shrink sleeve until the object(s) come(s) into abutment against an intermediate transverse line where the two walls of the sleeve adhere to each other.

BRIEF DESCRIPTION OF THE DRAWINGS

Other characteristics and advantages of the invention appear more clearly in the light of the following description and the accompanying drawings relating to a particular embodiment, and given with reference to the figures in which.

DESCRIPTION OF THE PREFERRED EMBODIMENTS

Figure 1:
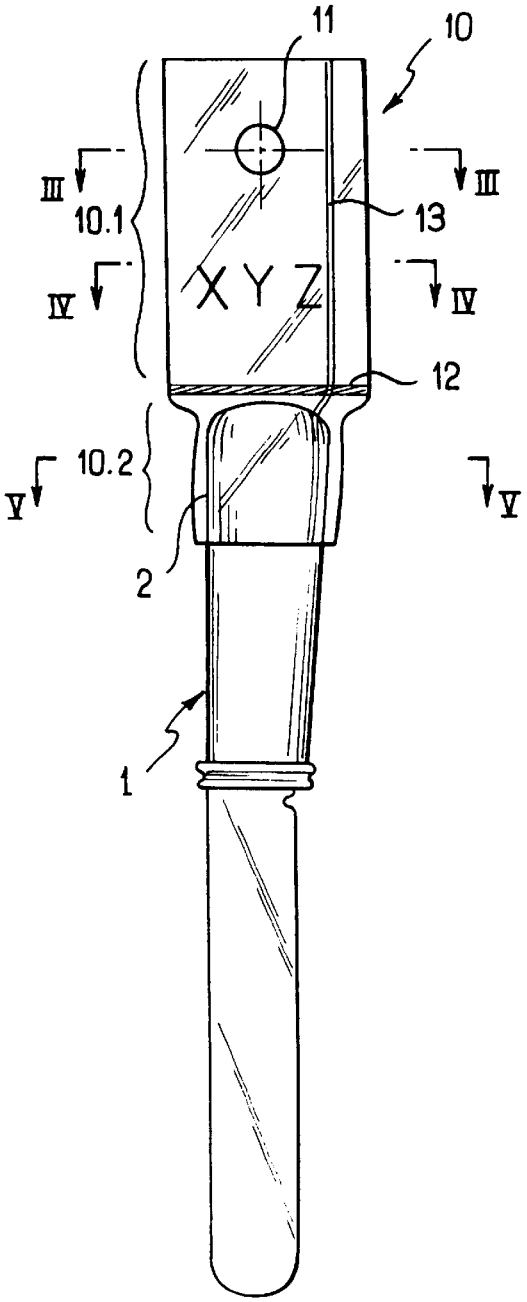
FIG. 1 is an elevation view showing a support device associated with an object to be suspended from a peg of a display unit, the bottom portion of the sleeve being shrunk onto the object in accordance with a characteristic of the invention.
Figure 2:
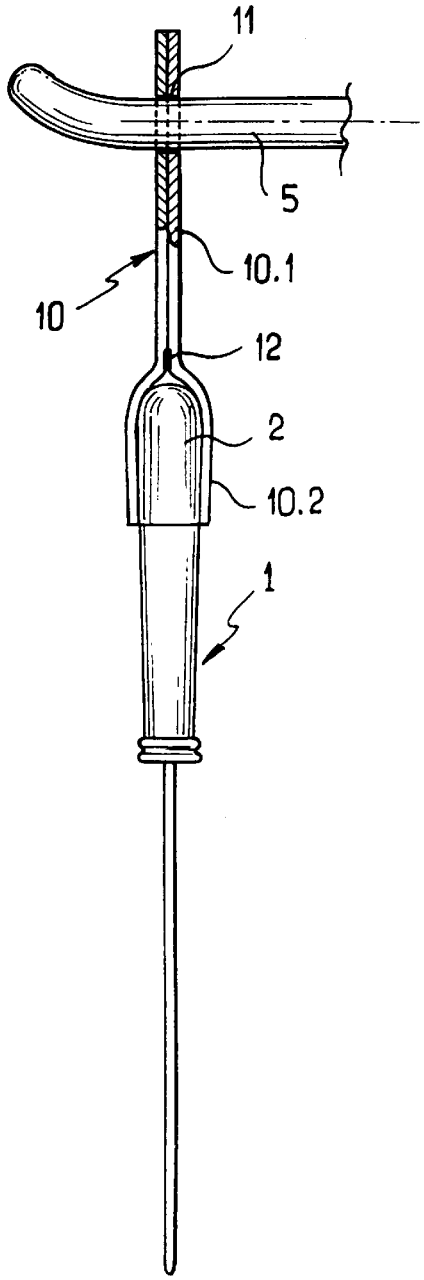
FIG. 2 is a side view of the above support device, showing it suspended from a peg of a display unit.

FIGS. 1 and 2 show a device 10 for supporting an object 1 which in this case is a knife, the support device being designed to be suspended from a peg of a display unit (in this case a single peg as can be seen in FIG. 2).

In accordance with an essential characteristic of the invention, the support device consists in a sleeve 10 of heat-shrink thermoplastic material having a top portion referenced 10.1 that is not shrunk, that is flattened face against face, and that has a through hole 11 for enabling the device to be suspended from a peg 5, and that has a bottom portion 10.2 that is shrunk onto a top portion referenced 2 of the object 1 so as to hold said object to enable it to be suspended. As can be seen in FIG. 2, the top portion 10.1 constituted by pressing together the two walls of the sleeve face against face in the non-shrunk state naturally forms a suspension plate, without there being any need to provide any additional component.

Figure 3:
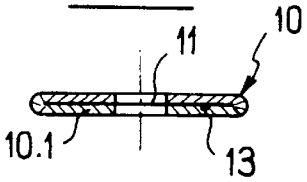
FIGS. 3, 4, and 5 are sections on III—III, IV—IV, and V—V of FIG. 1, showing more clearly how the walls of the sleeve constituting the present support device are organized.
Figure 4:
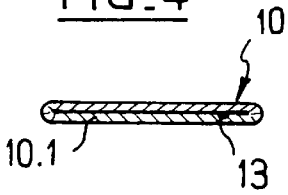
Figure 5:
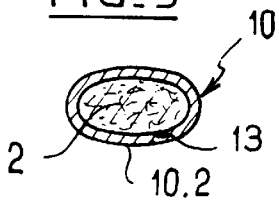

Specifically, the through hole 11 passes through both walls of the top portion 10.1 of the sleeve 10, as can be seen clearly in the section of FIG. 3. Nevertheless, it can be seen below that it is possible to double-up the wall so as to increase the strength of this top suspension portion so as to enable it to support heavier objects.

Because of the flat nature of this top portion 10.1, it is possible to print information and/or decoration thereon, and great freedom is available concerning printing on the front and/or the back, e.g. including a bar code, legal mentions, or a graphical representation of the product. Purely by way of illustration, this freedom in printing information and/or decoration is represented by the letters X, Y, and Z.

It is also advantageous to provide for the two walls of the sleeve 10 to adhere to each other along an intermediate transverse line, and specifically the line referenced 12 in FIGS. 1 and 2 which marks the boundary between the top portion 10.1 and the bottom portion 10.2 of the sleeve 10. This intermediate transverse line 12 can be a line of heat sealing between the two walls of the sleeve 10, or a line of adhesive between the two walls of the sleeve and implemented using an adhesive that is temperature-reactivatable.

Such an intermediate transverse line of adhesion is advantageous on two grounds: firstly it prevents any interference between the two portions of the sleeve while the bottom portion only thereof is being shrunk, thereby retaining the flat and undeformed nature of the top portion of the sleeve. Secondly, this intermediate transverse line constitutes a mechanical abutment that makes it considerably easier to put the device into position on an object prior to shrinking the bottom portion of the sleeve. This advantage can be seen even more clearly from the description below with reference to FIG. 11 concerning the method of the invention for wrapping objects.

The person skilled in the art will understand that it is possible to design other equivalent variants seeking to generate such intermediate abutment means marking the boundary between the non-shrunk top portion and the bottom portion which is shrunk on the object(s) to be supported. In particular, it is possible to provide a line of heat sealing made by using ultrasound or by means of hot jaws, or indeed to provide a specific system of cutouts organized to provide a locking or abutment effect (variants not shown herein).

It is also advantageous to provide for the sleeve 10 to carry a detection antenna for the purpose of conferring additional protection against "shrinkage", e.g. pilfering. Specifically, there is shown a detection antenna made in the form of a metal wire 13 extending along a generator line of the sleeve 10, and preferably extending over the full height of the sleeve as can be seen in FIG. 1. Such an antenna operates by resonance in association with an electronic surveillance system operating on a magnetic detection principle. Such detection means integrated in a wrapping sleeve provides protection against theft, and also facilitates management of the wrapped products because it is possible to provide for the wrapped products to be traceable. In this respect, reference can be made to the teaching of the Applicants' document EP-A-0 698 561.

Figure 6:
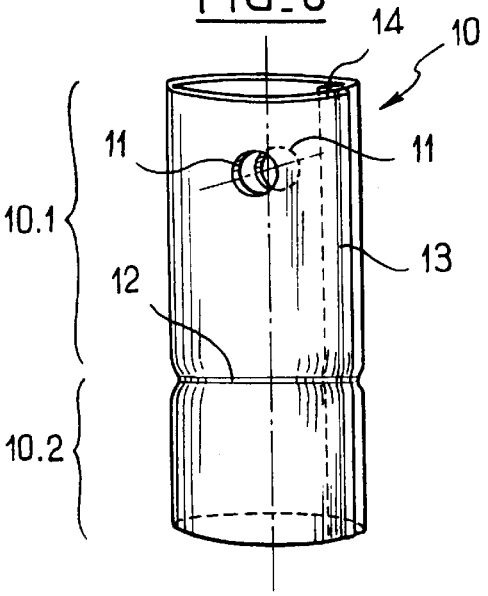
FIG. 6 is a perspective view showing a heat-shrink sleeve whose bottom portion is not yet shrunk, but which already presents a transverse intermediate line of adhesion.

FIG. 6 shows the sleeve 10 in its non-shrunk state as it presents prior to being engaged on a top portion of the object(s) concerned. The two through holes 11 can be seen as can the detection antenna 13 which in this case is disposed in the overlapping flap, i.e. in a line of heat sealing that unites the two edges of the film used to constitute a cylindrical sleeve. The sleeve 10 also has an intermediate transverse line 12 as mentioned above, marking the boundary between the top portion 10.1 and the bottom portion 10.2 of the sleeve.

Figure 7:
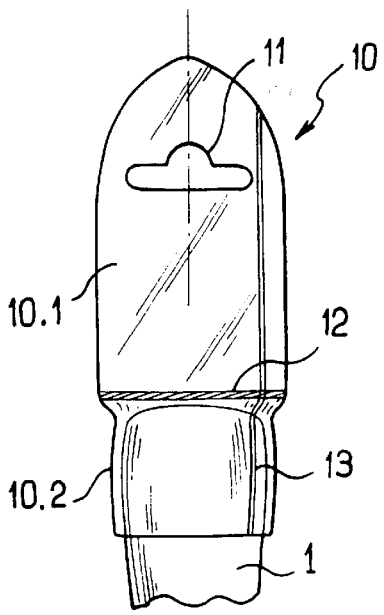
FIG. 7 is a fragmentary view showing the top portion of the sleeve constituting a variant having a hole for a dual peg and a shaped top end.

As a variant, FIG. 7 shows other options concerning the top portion 10.1 of the sleeve 10.

It can thus be seen that the through hole 11 is no longer in the form of a circle as illustrated above, but is of elongate shape making it possible for it to be suspended both from a single peg or from a dual peg (the term "European" is sometimes used to describe this form of dual-purpose hole). In FIG. 7, there can also be seen that the top end of the flat top portion 10.1 of the sleeve 10 is shaped. Specifically, the figure shows a bullet shape, however any personalized shape could be chosen.

When a group of objects is heavy, the mechanical strength provided by the two thicknesses of the sleeve at the through hole can turn out to be insufficient, giving rise to the risk of tearing at the hole. Under such circumstances, it is appropriate to reinforce the strength of the suspension zone. The variants shown in FIGS. 8 to 10 seek specifically to solve this problem.

Figure 8:
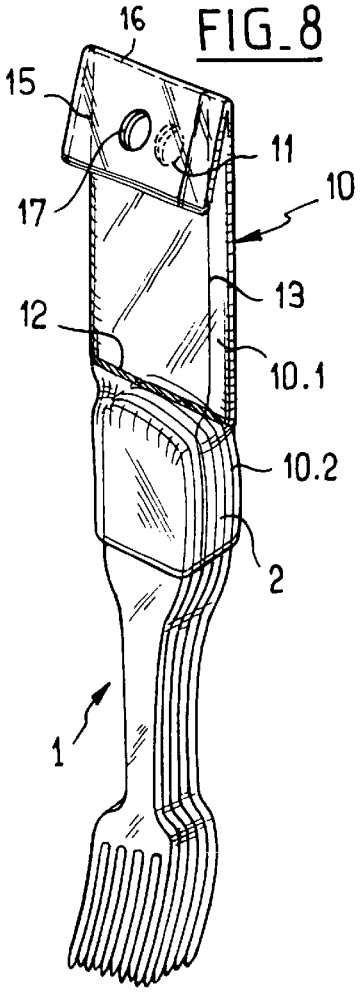
FIG. 8 is a perspective view showing a support device whose top portion has a folded-down end flap.
Figure 9:
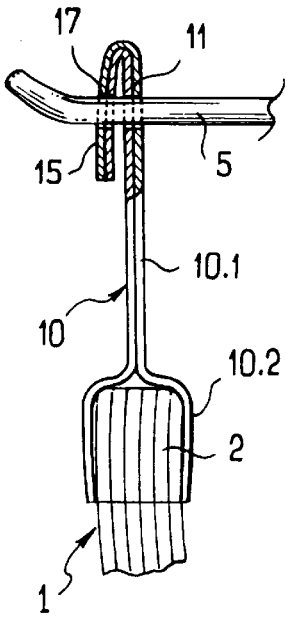
FIG. 9 is a side view showing the FIG. 8 device when suspended, and showing how the walls obtained in that way are doubled up.

As shown in FIGS. 8 and 9, it is possible to provide for the top portion 10.1 of the sleeve 10 to be folded at 16 so as to define an end flap 15 that can also be pierced by a through hole, referenced 17, which is brought into register with the above-mentioned through hole 11 when said end flap is folded down, thereby doubling the thickness of the walls in the suspension zone. The view of FIG. 9 shows clearly how support is provided by the four thicknesses of the wall. To make it easier to fold the end flap 15, it is possible, as shown in FIG. 8, to provide a fold that is defined by a circumferential line of microperforations, or in a variant to provide a fold that is defined by the walls of the sleeve being scored. In FIG. 8, the segment of the line of microperforations is shown as being rectilinear, but it will be understood that this is due to the flattened sleeve being folded down onto itself. It will also be observed in FIG. 8 that the sleeve 10 whose bottom portion 10.2 is heat-shrunk is being used in this case to support a group of objects and specifically a set comprising a plurality of superposed forks. The height of the shrunk sleeve can support such a group of objects without difficulty. Nevertheless, the weight of the objects requires the walls to be doubled-up as a safety measure.

Figure 10:
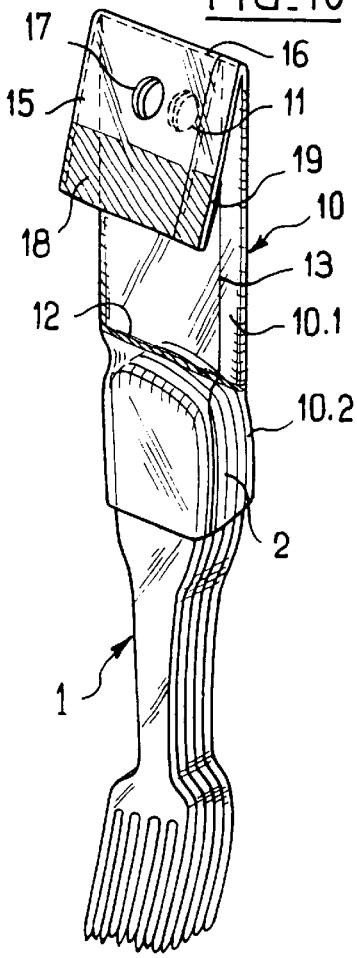
FIG. 10 is a perspective view showing a variant of the device of FIGS. 8 and 9 with the folded end of the flap having an adhesive extension.

It is also possible to provide for the end flap 15 to be fitted with an adhesive member seeking to hold down said flap. In FIG. 10, one possible implementation of such an adhesive member is shown in the form of an adhesive extension 18 to the end flap 15. Under such circumstances, it is preferable to provide a peel-off patch 19 that covers the face of adhesive, which patch is removed when it is desired to press down the flap 15 after it has been folded along the line 16. In a variant, an adhesive patch could be provided disposed on the inside face of the end flap 15, preferably in the center of said face (variant not shown herein). In some cases, this option for an adhesive end makes it possible to unfold the flap 15 and thus gain access to the inside of the sleeve, e.g. to gain access to the object if no intermediate line of heat sealing is provided.

Figure 11:
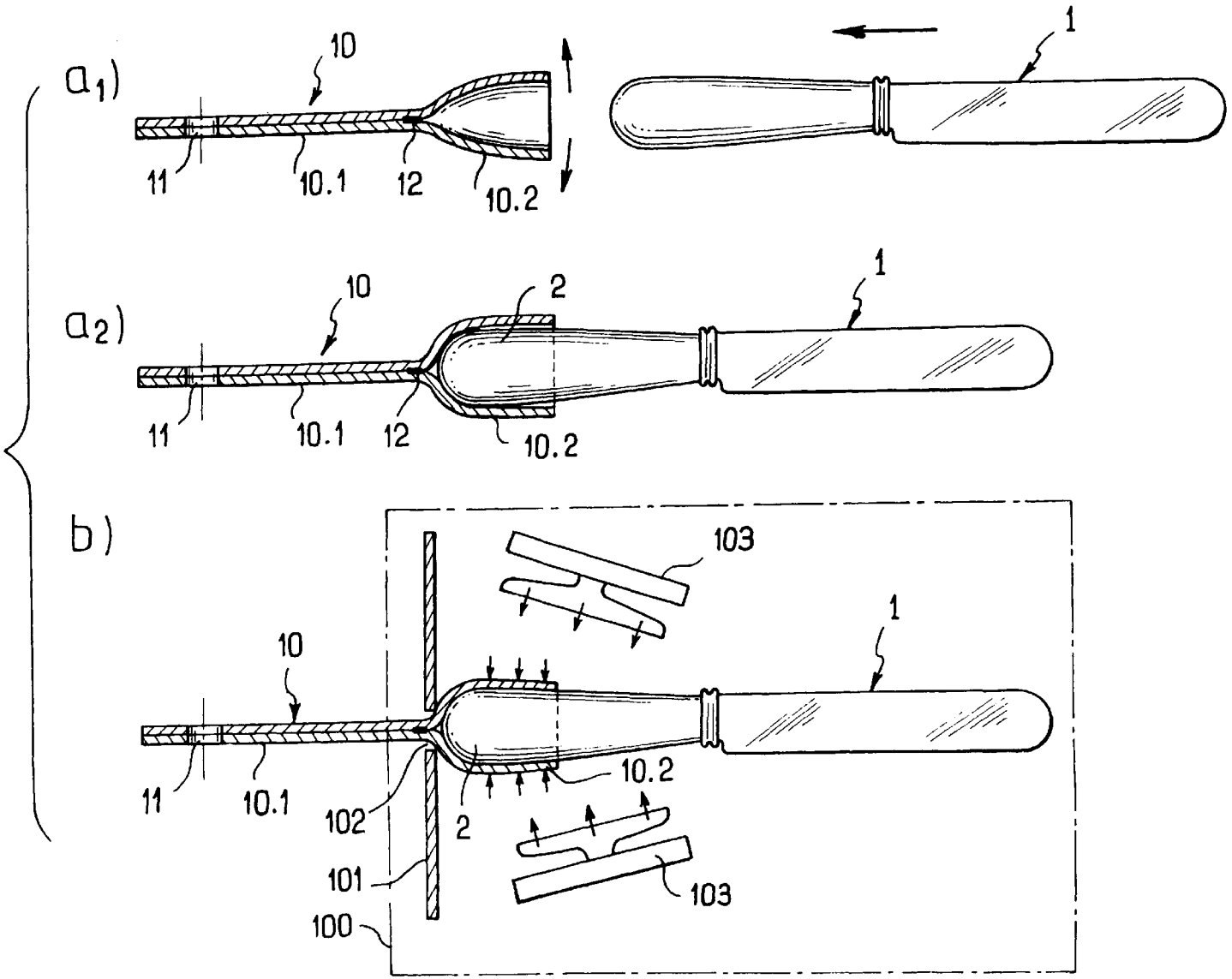
FIG. 11 is a diagram showing the successive steps in the method of wrapping at least one object that is to be suspended from a peg of a display unit, in accordance with the invention.

The wrapping method of the invention is described below with reference to the diagrams of FIG. 11. The method is a method of wrapping at least one object that is to be suspended from a peg of a display unit, by means of a heat-shrink sleeve of the type described above.

In a first step, a heat-shrink sleeve 10 is engaged on an end portion 2 of the object(s) 1, but covering only a portion of the length of said sleeve. Specifically, a heat-shrink sleeve 10 is provided that has an intermediate line of heat sealing 12. This first step thus comprises a step referenced $a_1$) in which the object is brought into the bottom compartment of the sleeve, and a second step referenced $a_2$) where the object 1 has come into abutment against the intermediate transverse line 12 where the two walls of the sleeve adhere to each other.

Thereafter, as shown in a step referenced b), the sleeve 10 is caused to shrink, but only the portion 10.2 thereof that surrounds the object 1, while the remaining portion 10.2 remains in the non-shrunk state, and is flattened face against face. This step is shown diagrammatically herein, as taking place in a shrinking tunnel represented by a chain-dotted rectangle 100. The assembly constituted by the not yet shrunk sleeve and the object(s) associated therewith travels on a conveyor belt (not shown herein) and moves past a screen 101 that has a longitudinal slot 102 of width corresponding substantially to two wall thicknesses of the sleeve. On one side of the screen 101 (to the right in FIG. 11) there are provided heater assemblies 103, e.g. infrared heaters, that generate sufficient heat to cause the wall of the heat-shrink sleeve to shrink. Shrinking then occurs only in that portion of the sleeve which lies in the zone exposed to the action of the heater elements. On the other side of the screen (to the left in FIG. 11), the corresponding portion of the sleeve is not exposed to the heat flux and consequently it does not shrink. The non-shrunk portion then constitutes the top portion of the sleeve for suspension purposes.

A support device is thus provided for supporting at least one object, the device providing high performance insofar as it is cheap to make because it comprises a single piece, and simple to put into place on one or more objects. Printability constraints can easily be satisfied since there is great freedom concerning printing on the front or the back of the wall of the heat-shrink sleeve, such printing generally being applied to the flat top portion of the sleeve. Satisfactory resistance against tearing is also provided, even when the object(s) concerned is/are heavy, because the film is of sufficient thickness (for example it is possible to provide a film of polyethylene terephthalate having a thickness of about 0.1 mm). In addition, by selecting a sleeve that is made of transparent plastics material, the appearance of the supported object is not spoilt in any way and that also constitutes a favorable element of the package. Finally, because of the detection antenna that is advantageously fitted, an additional advantage is provided of protection against "shrinkage", and it is also made easier to manage stocks because of the traceability conferred on the objects.

The invention is not limited to the embodiments described above, but on the contrary covers any variant that uses equivalent means to reproduce the essential characteristics specified above.

What is claimed is:

1. A device for supporting at least one object that is to be suspended from a peg of a display unit along a substantially vertical suspension direction, the device comprising a sleeve (10) of heat-shrink plastics material having a central axis parallel to said suspension direction, said sleeve having a non-shrunk top portion (10.1) which is flattened face against face and has a first through hole (11) for suspending the device, said top portion having a fold (16) defining an end flap (15) that has a second through hole (17) which, once said end flap has been folded down, comes into register with said first through hole (11) so as to double the number of walls in the suspension zone, said end flap (15) including an adhesive member (18) for ensuring that said end flap (15) is held down after folding and a bottom portion (10.2) which is shrunk on a top portion of said at least one object so as to wholly cover a top perimeter of said top portion.

2. A device according to claim 1, wherein the through hole (11) passes through both walls of the top portion (10.1) of the sleeve (10).

3. A device according to claim 1 wherein the fold (16) is defined by a circumferential line of microperforations or by scoring.

4. A device according to claim 1, wherein both walls of the sleeve (10) adhere to each other via an intermediate transverse line (12) marking the boundary between the top portion (10.1) and the bottom portion (10.2) of said sleeve.

5. A device according to claim 4, wherein the intermediate transverse line (12) is a line of heat sealing between the two walls of the sleeve (10).

6. A device according to claim 4, wherein the intermediate transverse line (12) is a line of adhesive between the two walls of the sleeve (10) implemented by means of a temperature-reactivatable adhesive.

7. A device according to claim 1, further including printed information and/or decoration on the flat top portion (10.1) of the sleeve (10).

8. A device according to claim 1, wherein the flat top portion (10.1) of the sleeve (10) has an upper outer edge that extends along a predetermined profile.

9. A device according to claim 1, wherein the sleeve (10) carries a detection antenna (13) in the form of a metal wire extending along a generator line of said sleeve.

10. A device according to claim 9, wherein said metal wire extends along the full height of said sleeve.

* * * * *